US010669689B2

(12) United States Patent
Gillard

(10) Patent No.: US 10,669,689 B2
(45) Date of Patent: Jun. 2, 2020

(54) HYDROMILL WHEEL WITH SINGLE DISC CUTTING ROLLERS

(71) Applicant: VSL INTERNATIONAL AG, Köniz (CH)

(72) Inventor: Jean-Christophe Gillard, Hong Kong (CN)

(73) Assignee: VSL INTERNATIONAL AG, Koniz (CH)

( * ) Notice: Subject to any disclaimer, the term of this patent is extended or adjusted under 35 U.S.C. 154(b) by 201 days.

(21) Appl. No.: 14/762,511

(22) PCT Filed: Jan. 29, 2013

(86) PCT No.: PCT/EP2013/051672
§ 371 (c)(1),
(2) Date: Jul. 22, 2015

(87) PCT Pub. No.: WO2014/117814
PCT Pub. Date: Aug. 7, 2014

(65) Prior Publication Data

US 2015/0322644 A1 Nov. 12, 2015

(51) Int. Cl.

| | |
|---|---|
| ***E02F 3/20*** | (2006.01) |
| ***E02F 3/24*** | (2006.01) |
| ***E02F 5/08*** | (2006.01) |
| ***E21B 10/50*** | (2006.01) |
| ***E02F 3/92*** | (2006.01) |

(52) U.S. Cl.
CPC ..... *E02F 3/20* (2013.01); *E02F 3/205* (2013.01); *E02F 3/241* (2013.01); *E02F 3/245* (2013.01); *E02F 3/9237* (2013.01); *E02F 5/08* (2013.01); *E21B 10/50* (2013.01)

(58) Field of Classification Search
CPC ... E02F 3/205; E02F 3/20; E02F 3/241; E02F 3/245; E02F 3/9237; E02F 5/08; E02D 17/13; E02D 17/06; E21B 10/50
USPC ..... 37/91, 364
See application file for complete search history.

(56) References Cited

U.S. PATENT DOCUMENTS 4,009,909 A * 3/1977 Robbins ..... E21B 4/18 173/36
4,548,442 A * 10/1985 Sugden ..... E21D 9/10 299/10
5,035,071 A * 7/1991 Stotzer ..... E02D 17/13 299/106

(Continued)

FOREIGN PATENT DOCUMENTS

DE 19838513 A1 4/1999

OTHER PUBLICATIONS

International Search Report and Written Opinion dated Oct. 10, 2013 for PCT/EP2013/051672.

*Primary Examiner* — Jamie L McGowan
(74) *Attorney, Agent, or Firm* — Pearne & Gordon LLP

(57) ABSTRACT

A hydromill wheel (5) for excavating a trench in hard rock includes a drum (4) arranged to be rotated about its axis (A, B). The wheel (4) further includes a plurality of single disc cutters (11) mounted on the periphery of the drum (5), the single disc cutter (11) having a rotatable single cutting disc (11) arranged to come in contact with and crush the rock during excavation. The spacing of the projection of at least some of the cutting discs (11) on the drum axis (A, B) is 20% to 70% of the cutting disc diameter.

20 Claims, 5 Drawing Sheets

(56) References Cited

U.S. PATENT DOCUMENTS

| | | | | |
|---|---|---|---|---|
| 5,234,257 | A * | 8/1993 | Sugden | E21D 9/1093 299/10 |
| 5,308,151 | A * | 5/1994 | Sugden | E21D 9/1013 299/110 |
| 5,924,222 | A | 7/1999 | Stoetzer | |
| 6,944,977 | B2 * | 9/2005 | Deniau | E02F 3/205 175/355 |
| 7,363,733 | B2 * | 4/2008 | Stoetzer | E02D 17/13 175/96 |

* cited by examiner

HYDROMILL WHEEL WITH SINGLE DISC CUTTING ROLLERS

TECHNICAL FIELD

The present invention relates to hydromills suitable for excavating trenches in hard or very hard rock. The invention also relates to a corresponding hydromill wheel and to a method of excavating by using the hydromill.

BACKGROUND OF THE INVENTION

Trench cutters, also known as hydromills under their generic name, are used in foundation engineering processes, for instance to build diaphragm walls. Trench cutter systems comprise generally a frame, such as a steel frame, that can be lowered into the ground that is being excavated. Normally a motor and two cutter wheel pairs, which are arranged to be rotated by the engine, are installed at the end of the frame that is to be first lowered in the ground. Each wheel pair has a first wheel and a second wheel arranged so that one engine is arranged inside these two wheels or drums. The cutter can be lowered vertically under continuous rotation of the cutter wheels, and depths of more than 150 m can be reached. The advance is brought about by the weight of the cutter wheels and the frame, which is hung by means of cables to a crane. Due to the rotation of the cutter wheels, the ground below the wheels is continually loosened or broken down and conveyed back to the surface by using a mud pump just above the cutter wheels and a suction means between the wheels.

In the known solutions the hydromill wheels are normally equipped with different kinds of teeth or drag bits that are designed to come in contact with the ground and to perform the actual breaking of the ground. However, when excavating hard or very hard rock, these teeth or drag bits become inefficient, and the hydromill can be brought to a standstill, i.e. it is no longer able to penetrate the rock. In order to be able to continue the excavation, the hydromill has to be withdrawn from the trench, and a heavy chisel (typically 12 to 20 tons) has to be dropped several times on the rock to sufficiently fracture it first, before the hydromill can be brought again and resume excavation. As the fracturing effect of chiselling is limited in depth below the rock surface on which the chisel is dropped, this process of alternating chiselling and excavation with the hydromill equipped with drag bits or other types of teeth must be repeated several times, resulting in very slow progress. In addition, on some building sites with neighbouring sensitive structures, such as for example old buildings in poor condition, historical monuments or data centres, there are limits for the allowed vibrations, and consequently chiselling is sometimes prohibited on these sites.

To mitigate this problem it has been designed to use rollers with button bits (rounded studs) instead of the teeth or drag bits. However, this solution is also not optimal, since cutter systems have a limited weight, and in the case of rollers with button bits, there would be too many button bits in contact with the rock at the same time, resulting in an insufficient pressure to crush the rock at a particular time.

It is the object of the present invention to overcome the problems identified above related to excavating hard or very hard material, such as rock.

SUMMARY OF THE INVENTION

According to a first aspect of the invention, there is provided a hydromill wheel for excavating a trench in hard rock, the wheel comprising:

a drum arranged to be rotated about its axis; and a plurality of single disc cutters mounted on the periphery of the drum, the single disc cutter having a rotatable single cutting disc arranged to come in contact with and crush or cut the rock during excavation, wherein the spacing of the projections of at least some of the cutting discs on the drum axis is 5% to 70% of the cutting disc diameter.

The proposed arrangement with single disc cutters having very small surface area in contact with the rock offers a new solution that allows excavating trenches efficiently even in hard or very hard rock with rock strength exceeding 150 $MN/m^2$. Since the single disc cutters have only a very small surface area in contact with the rock at any given time, huge crushing forces or pressures can be obtained. Furthermore, the single disc cutters can be distributed, evenly if necessary, all around the circumference of the wheels, which has a further advantage that only a few of the discs are in contact with the rock at any given time, i.e. only those which happen to be at the bottom at that particular time.

Another advantage with the discs (as opposed to button bits for example) is that the rock chips are created between the traces of the discs, by creating fractures in the rock which are below, and substantially parallel to, the free surface of the rock. Thus, the rock chips created are much larger than those formed by button bits. Button bits just locally crush the rock into powder, which requires more energy (and therefore time, for the same thrust) than forming larger chips.

According to a second aspect of the invention, there is provided a hydromill comprising the hydromill wheel according to the first aspect of the invention, and further comprising a frame at one end of which the hydromill wheel is mounted, and wherein the hydromill comprises four hydromill wheels arranged in two pairs so that each of the hydromill wheels of a first pair has a first rotational axis, whereas each of the hydromill wheels of a second pair has a second rotational axis, the first and second rotational axes being different.

According to a third aspect of the invention, there is provided a method of excavating a trench in rock by use of a hydromill having at least one drum equipped with single disc cutters, the method comprising:

rotating the drum about its axis by an engine;

arranging a plurality of single disc cutters mounted on the periphery of the drum to come in contact with the rock, the single disc cutter having a rotatable single cutting disc; and while lowering the drum into the rock the single disc cutters creating fractures in the rock for excavating the rock, the spacing of at least some consecutive fractures being 10 mm to 70 mm.

Other aspects of the invention are recited in the dependent claims attached hereto.

BRIEF DESCRIPTION OF THE DRAWINGS

Other features and advantages of the invention will become apparent from the following description of non-limiting exemplary embodiments, with reference to the appended drawings, in which.

DETAILED DESCRIPTION OF AN EMBODIMENT OF THE INVENTION

Figure 1:
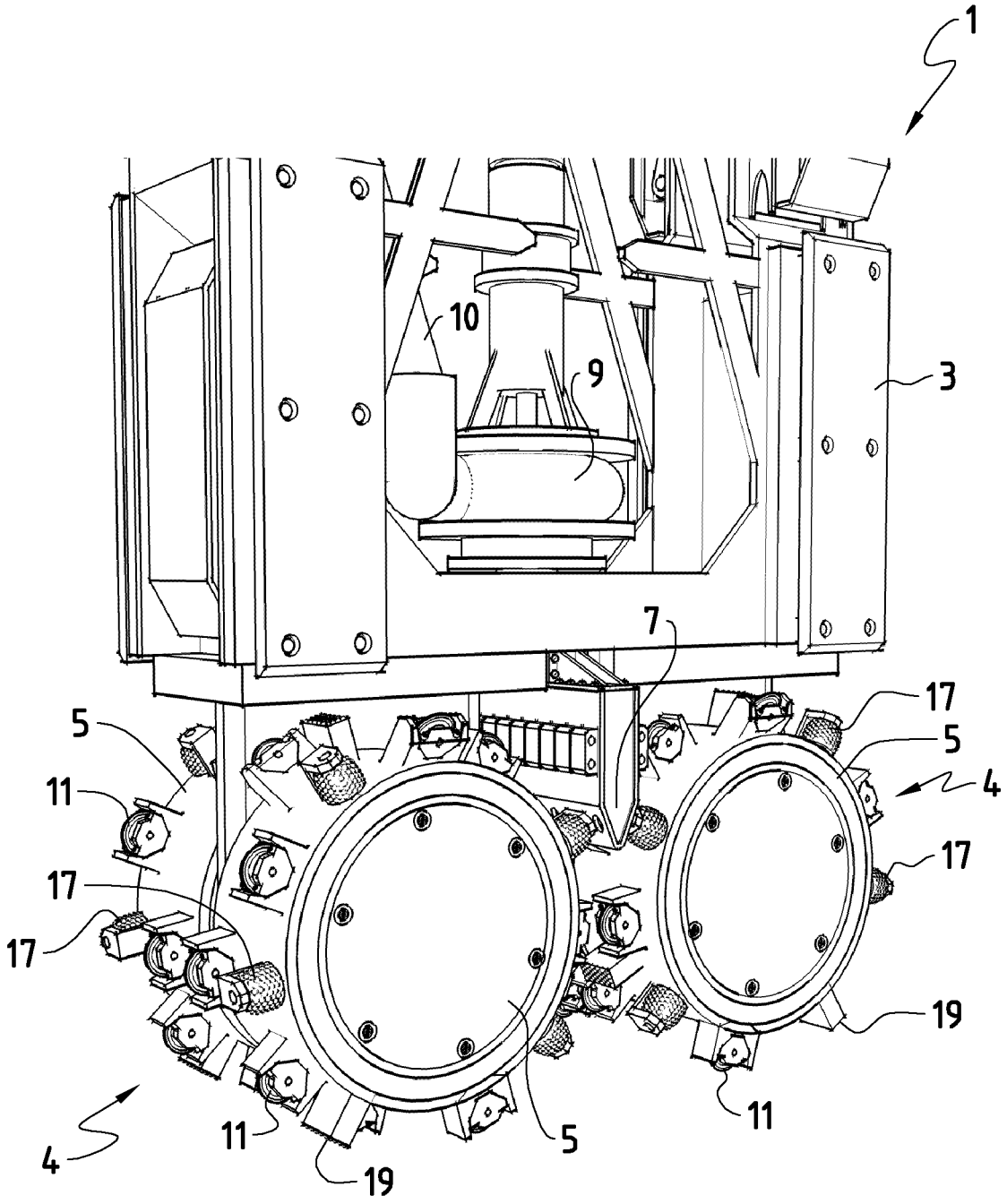
FIG. 1 is a perspective front view of the lower part of a hydromill according to an embodiment of the present invention.

One embodiment of the present invention will be described in the following in more detail with reference to the attached figures. Identical functional and structural elements which appear in the different drawings are assigned the same reference numerals.

FIG. 1 illustrates in a perspective front view the lower end of a hydromill 1 suitable for excavating for instance trenches in a hard rock. The upper end of the hydromill 1 is not shown, and also elements external to the hydromill itself, such as the crane, are omitted in the following description. These external elements are not important to understand the teachings of the present invention. A hydromill frame 3 forms the top part of the hydromill 1, while wheels 4 form the bottom part of the hydromill 1. The system 1 has two wheel pairs, i.e. altogether four wheels 4. The wheels 4 of one pair can be considered to rotate around the same rotational axis A, B, shown in FIGS. 4 and 5.

A motor (not shown) for rotating the wheels 4 is located at least partially inside an assembly formed by a wheel pair. The first and second wheels 4 of one pair can have the same or different rotational speed compared with the cutter wheels 4 of the other pair. In other words, the wheels 4 of one pair are designed to be rotationally independent from the wheels 4 of the other pair. These wheels 4 are arranged to reach rotational speeds of up to 30 rpm. However, the teachings of the invention are equally applicable to solutions that have higher rotational speeds. A pumping inlet means 7, also called a suction box, is mounted between the two pairs of wheels to suck the excavation slurry containing the soil and crushed rock debris out from the trench. Connected to the pumping inlet means 7 and mounted at the bottom part of the frame 3 there is also shown a pump 9 to transport the excavation slurry containing the soil and crushed rock debris to the surface through a hose 10.

The width C (referring to FIG. 5) of the hydromill system 1 can take different values depending on the width of the trench to be excavated. Typically the width C can be 0.6 m, 0.8 m, 1.0 m, 1.2 m or 1.5 m, but of course other values are equally possible. Thus, the width of the wheels 4 can be designed to vary for different widths of the trenches. The outer cross-sectional diameter of the drums on which the cutting elements are mounted is normally within the range of 0.6 m to 1.2 m.

Figure 2:
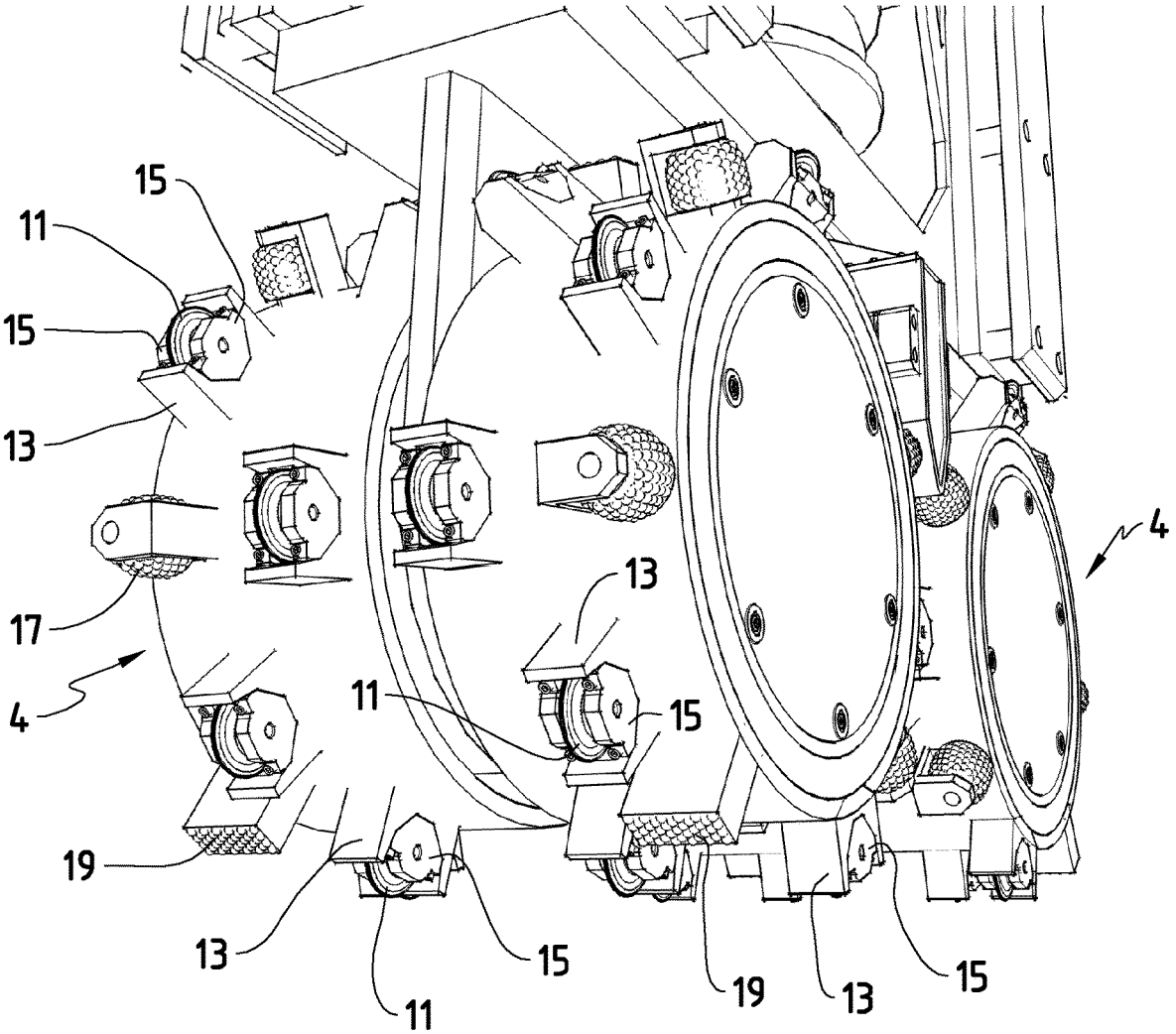
FIG. 2 is a perspective view showing the bottom part of the hydromill of FIG. 1 in more detail.
Figure 3:
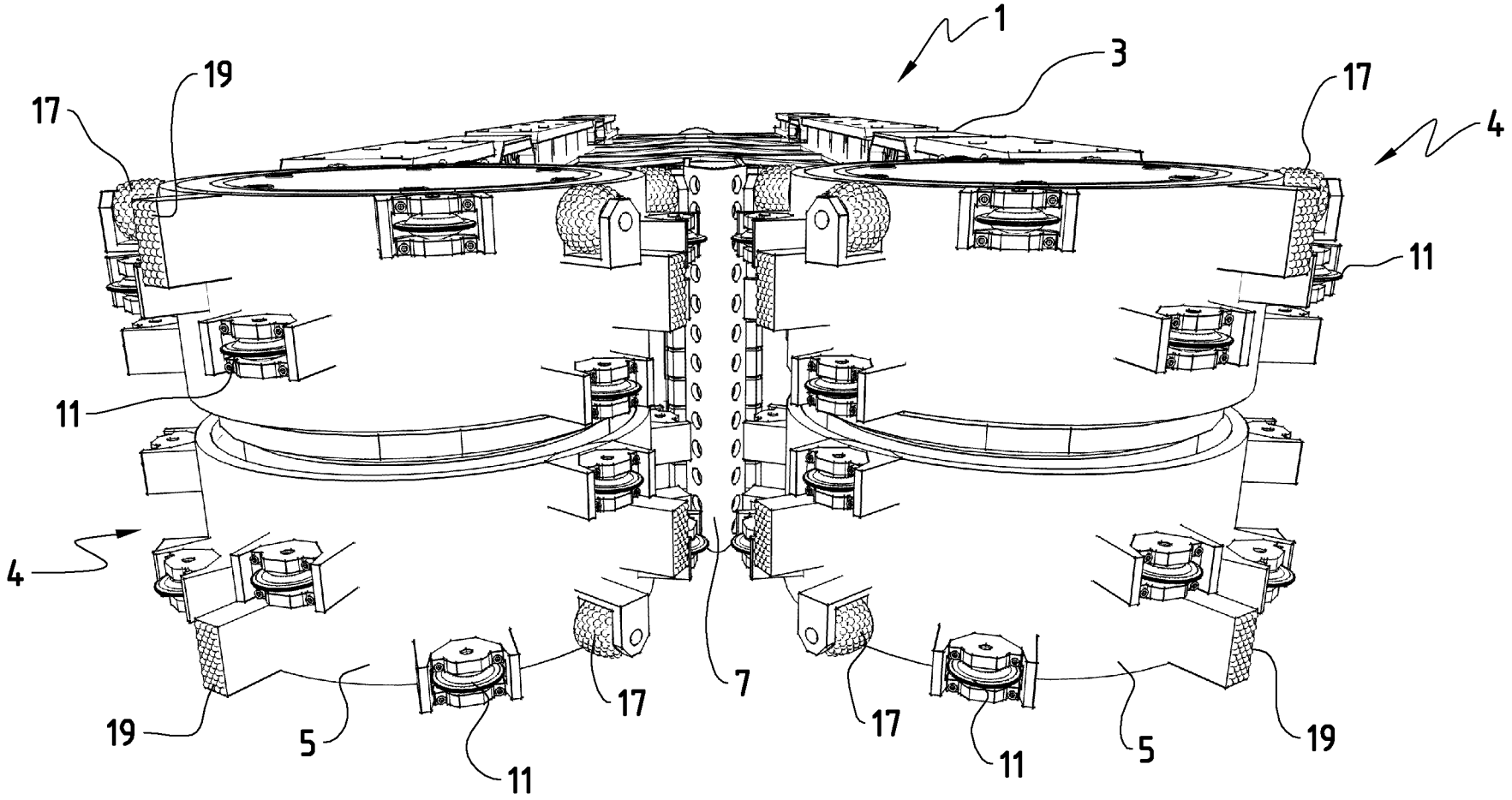
FIG. 3 is a perspective view showing the bottom part of the hydromill of FIG. 1 in more detail but seen from underneath.

As illustrated in the figures, the basic element of the wheels 4, is a drum 5, which is a cylindrical element, and the outer periphery of the drums 5 is equipped with cutting elements, which in the illustrated example are single disc cutters 11, so that each single disc cutter comprises a rotatable single cutting disc 11. In other words, the single disc cutters 11 are mounted on the peripheral or circumferential surface of the drums, where the peripheral surface defines a cylinder which is parallel to the rotational axis A, B of the wheel or drum. These disc cutters are shown in more detail in FIG. 2. These single disc cutters 11 differ for instance from double or triple disc cutters in that the single disc cutters only have one cutting disc and not many. In the illustrated example, each drum 5 is equipped with eleven single disc cutters 11. The diameter of these disc cutters is preferably between 10 cm and 35 cm, and these cutting discs are circular in this example. In some implementations the diameter of these discs is between 15 and 30 cm and could be e.g. substantially 25 cm for each cutting disc on the drum. Thus, due to their small diameter, they can be called mini-disc cutters 11. In the illustrated example these disc cutters 11 are mounted partly inside a main support element or housing 13 of which at least one side is open to allow the discs 11 to come in contact with the rock to cut it. The lateral sides of the main support element 13 have lateral support elements 15 that allow the discs 11 to be fixed in place while allowing them to rotate freely when in contact with the rock. At least the main support elements 15 can be integral or monolithic with the drum 5.

Figure 5:
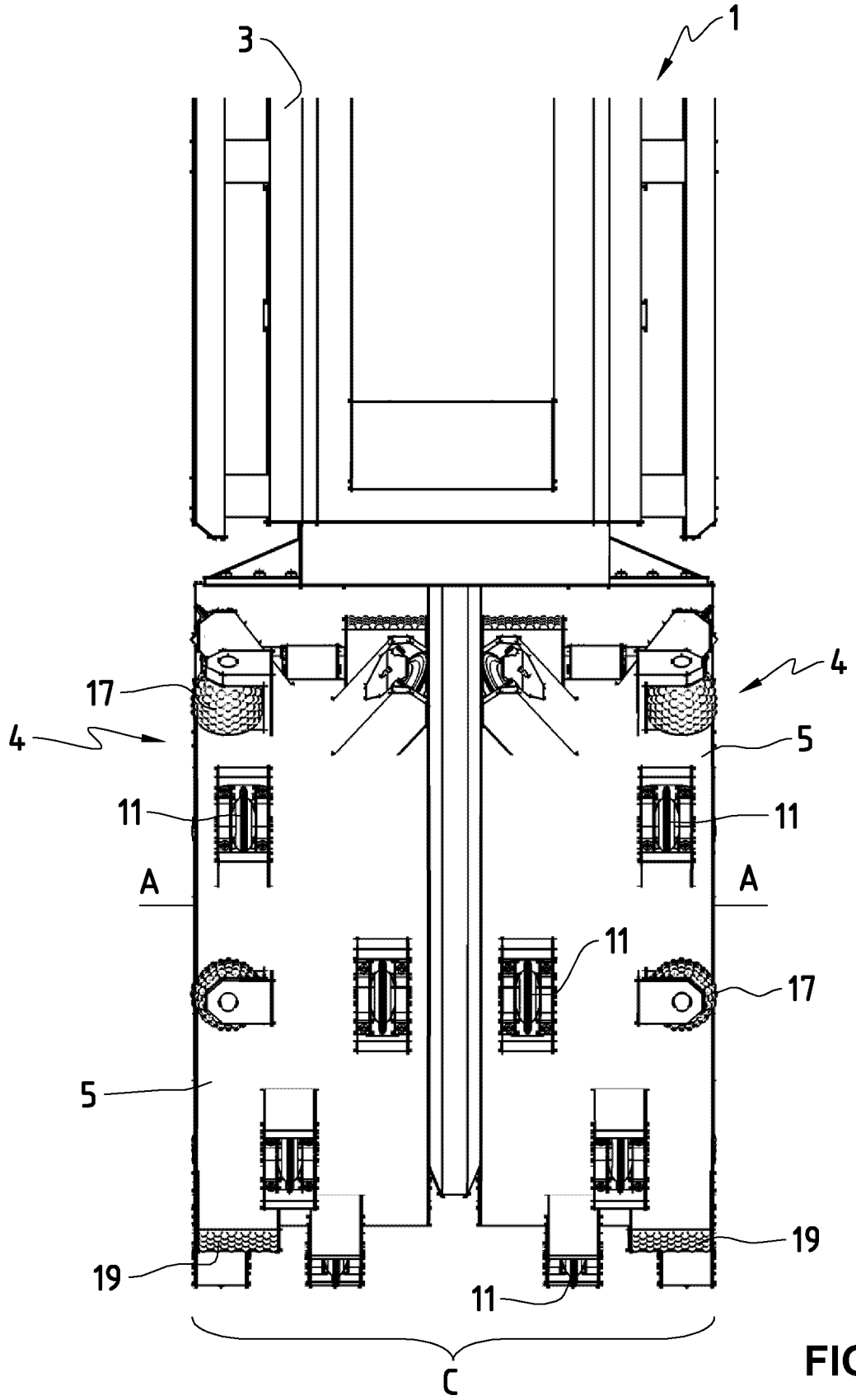
FIG. 5 is a schematic side view illustrating the bottom part of the hydromill of FIG. 1.

Some of the disc cutters 11 are mounted on the circumferential surface of the drum 5 so that these disc cutters form a 90 degree angle with respect to the circumferential surface of the drum 5. In other words the rotational axis of the single cutting discs is parallel to the rotational axis of the drums 5 or wheels 4. However, in the illustrated example, and as shown in FIG. 5, each wheel 4 has two disc cutters that are inclined with respect to the circumferential surface of the drum 4. In this example the angle is about 45 degrees. However, angles between 30 and 60 degrees could be equally possible, for instance, and the number of these inclined disc cutters on each drum 4 is not limited to two, for example more than two such angled disc cutters may be required. Having the disc cutters 11 angled with respect to the cutter wheel surface has the advantage that the excavation can be done efficiently for the entire width of the wheel 4. As further shown in FIG. 5, these inclined or angled disc cutters 11 are arranged so that each lateral side (left and right sides in this figure) of the cutter wheel 4 has at least one angled disc cutter 11. The disc cutters 11 can be made of steel or any other hard material. Their cutting edge can be made of even stronger material that is arranged to come in contact with the rock during excavation. Thus, if required to better resist abrasion or breakages, the material of the cutting edge can be advantageously different from the material of the cutting disc itself. There are various different grades and chemical compositions of steel (for example) as a parent material and also various treatments (plasma coatings, nitriding, heat treatments, diamond impregnation, hard facing, inclusion of carbide, etc.) which can be applied. Thus, on the cutting edge there could be a coating with the stronger material or this cutting edge could also be somehow bonded/fused etc. with the central part of the disc.

As shown in the figures, the wheels 4 are also equipped with other types of rollers, namely button bit rollers 17. In this example, each wheel 4 comprises four button bit rollers 17 and the rotational axis of these button bit rollers 17 forms an angle of 90 degrees with respect to the rotational axis of the wheel 4. These button bit rollers 17 are mounted on the trench facing side of the drum periphery so that they can come in contact with the vertical wall of the trench to stabilise the system or the wheels 4 laterally. These button bit rollers 17 are not necessarily designed to perform any excavation.

Figure 4:
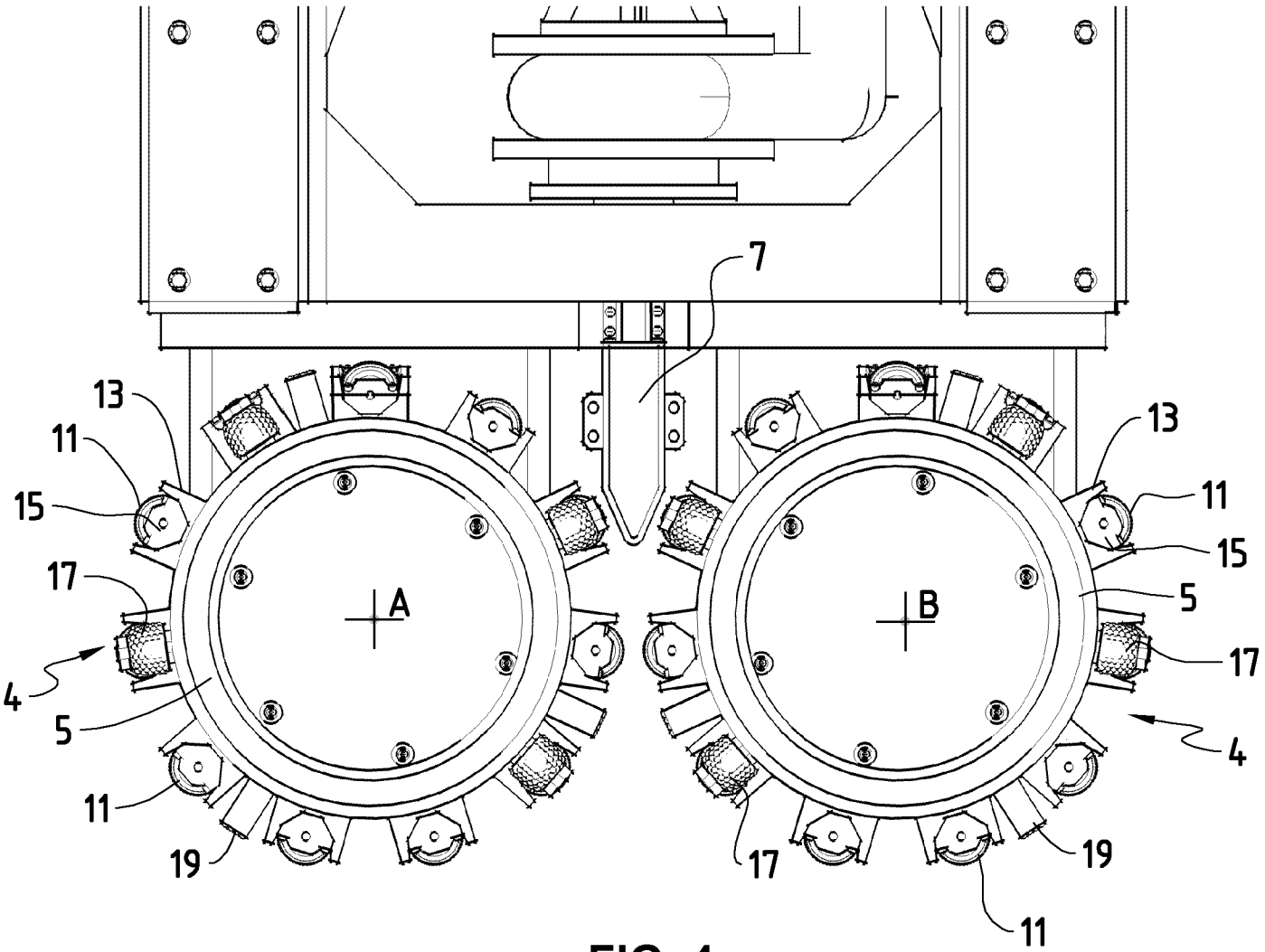
FIG. 4 is a schematic front view illustrating the bottom part of the hydromill of FIG. 1.

The drums 5 are also equipped on their periphery with cleaning means 19, such as brushes that are arranged to wipe the crushed rock toward the pumping inlet means 7. In this example three cleaning means 19 are mounted on each drum 5. With reference to FIG. 4, during operation the wheel shown on the left is rotated counterclockwise around axis A while the wheel on the right rotates clockwise around axis B, thus assuring that the crushed rock can be efficiently transported toward the pumping inlet means 7. However, the wheels 4 also have the ability to turn in the other direction of rotation. For example if a large piece of rock or other obstruction gets stuck between the wheel on the left (axis A) and the wheel on the right (axis B), below the suction box 7, then it is possible to unblock the wheels and let the obstruction fall back down by rotating the wheels in the opposite direction than the "normal" direction when excavating.

The disc cutters 11 illustrated in the figures are mounted on the drum periphery so that the distance from the vertical trench wall facing side of the wheel 4 is different for each disc cutter 11. It has been discovered that the spacing of the disc traces, in other words their projection on the cutter wheel axis A, B, is preferably 5% to 70% of the disc diameter or if expressed directly in terms of length, then the lateral spacing (in the direction of the axis A, B) of the disc traces is preferably between 10 mm and 70 mm, and in some implementations between 10 and 40 mm. With this arrangement, for instance for typical granite with ultimate compressive strength equalling about 150 $N/mm^2$ and tensile strength of around 8 $N/mm^2$, cracks on the rock created by the disc cutters 11 still join. For instance, if the disc diameter is about 125 mm, then with a spacing of discs of about 50 mm or less, the cracks still join during the excavation. In the illustrated example the disc cutters are evenly distributed on the drums 4 when seen from the lateral side of the drum 4, in other words the angular spacing, when seen from the direction of the drum axis A, B, between the disc cutters 11 is the same all around the wheel 4. However, the angular spacing does not have to be the same. Also the spacing of the disc traces on the rock in this example is constant; in other words the distances between two consecutive tracings have the same values. However, sometimes a smaller spacing is required toward the trench facing side (where the button bit rollers or stabilisers 17 are). In other words, does not have to be constant. For instance, the spacing may be constant for certain number of the disc cutters, e.g. in the middle of the drum, while towards the edges of the drum the spacing may not be constant from one disc cutter to another. For instance, in the case where a wheel has 19 disc cutters, then at the centre of the drum there could be 13 equally spaced disc cutters, while the remaining disc cutters towards both drum edges could have non-constant spacing from one disc to another. This is also why it may be necessary to have more than one angled disc on that side of the drum 5.

Above a wheel assembly 4 was described having a layout of 44 disc cutters 11 for building a 1 m wide diaphragm wall. In the example described, the assembly 4 was described to have also other elements, such as the button bit rollers 17 and the cleaning means 19. The disc projection spacing on the cutter wheel axis A, B in that configuration is about 46 mm. The total weight of the cutter system 1 is about 45 tons. Only the discs 11 at the bottom are in contact with the rock at any given time. With that configuration a force of around 3.5 to 4.5 tonnes per disc can be obtained, which is enough to crush the rock. It is possible, however, to deviate from the example described above in many ways. For instance, instead of having 11 disc cutters on each cutter wheel, the number of the disc cutters could be between 8 and 30 for each wheel, and in certain specific implementations this number could be e.g. 19 or 21. Furthermore, the disc diameters can have different values from the values explained above. The greater the disc diameter becomes, the fewer discs should be used, or the narrower the cutting edge should be, in order to have enough crushing force or pressure for each disc. We could also make a link between the width of the drum and the number of discs in the following manner. The number of the discs per cutter wheel is preferably between 15 and 55 times the width of the drum expressed in metres, and in some specific solutions the number of the discs per cutter wheel is between 30 and 50 times the width of the drum expressed in metres.

While the invention has been illustrated and described in detail in the drawings and foregoing description, such illustration and description are to be considered illustrative or exemplary and not restrictive, the invention being not limited to the disclosed embodiments. Other embodiments and variants are understood, and can be achieved by those skilled in the art when carrying out the claimed invention, based on a study of the drawings, the disclosure and the appended claims.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the invention.

The invention claimed is:

1. A hydromill wheel for excavating a trench in hard rock, the wheel comprising:

a drum arranged to be rotated about an axis extending laterally below a body of a hydromill; and a plurality of single disc cutters mounted on a periphery of the drum, each said single disc cutter having a rotatable single cutting disc, each said rotatable single cutting disc having a single cutting edge arranged to come in contact with and crush or cut the rock during excavation, wherein a spacing between projections of at least two consecutive cutting discs on the drum axis is 5% to 70% of the cutting disc diameter, and wherein a weight of the hydromill is supported by the single disc cutters at a bottom of the drum for cutting the rock disposed below the hydromill.

2. The hydromill wheel according to claim 1, wherein the diameter of at least some of the cutting discs is between 10 cm and 35 cm.

3. The hydromill wheel according to claim 1, wherein the rotational axis of at least some of the cutting discs is substantially parallel to the rotational axis of the drum.

4. The hydromill wheel according to claim 1, wherein the rotational axis of at least some of the cutting discs is not parallel to the rotational axis of the drum.

5. The hydromill wheel according to claim 4, wherein the angle between the rotational axis of at least some of the cutting discs and the rotational axis of the drum is between 30 and 60 degrees.

6. The hydromill wheel according to claim 5, wherein the cutting discs having a rotational axis not parallel with respect to the rotational axis of the drum are mounted on the drum so that at least one disc cutter is mounted at opposing edges on the peripheral surface of the drum.

7. The hydromill wheel according to claim 1, wherein the number of the single disc cutters mounted on the drum is between 8 and 30.

8. The hydromill wheel according to claim 1, wherein an angular spacing, when seen from the direction of the drum axis, between two consecutive single disc cutters is the same as the angular spacing between other two consecutive single disc cutters.

9. The hydromill wheel according to claim 1, wherein the angular spacing, when seen from the direction of the drum axis, between any two consecutive single disc cutters is constant.

10. The hydromill wheel according to claim 1, wherein at least one button bit roller is further mounted on the periphery of the drum so that the rotational axis of the at least one button bit roller has an angle of substantially 90 degrees with respect to the rotational axis of the drum.

11. The hydromill wheel according to claim 1, wherein the spacing of the projections of the cutting discs on the drum axis becomes smaller toward the trench facing side of the drum.

12. The hydromill wheel according to claim 1, wherein at least one cleaning means is further mounted on the periphery of the drum.

13. The hydromill wheel according to claim 1, wherein the cutting edge of the cutting discs arranged to come in contact with the rock is made of a harder material than the remaining parts of the cutting disc.

14. The hydromill comprising the hydromill wheel according to claim 1, and further comprising a frame at one end of which the hydromill wheel is mounted, and wherein the hydromill comprises four hydromill wheels arranged in two pairs so that each of the hydromill wheels of a first pair has a first rotational axis, whereas each of the hydromill wheels of a second pair has a second rotational axis, the first and second rotational axes being different.

15. The hydromill wheel according to claim 1, wherein the spacing between the projections of the at least two consecutive cutting discs on the drum axis is 20% to 70% of the cutting disc diameter.

16. The hydromill wheel according to claim 1, wherein the spacing between the projections of the at least two consecutive cutting discs on the drum axis is 10 mm to 70 mm.

17. The hydromill wheel according to claim 16, wherein the spacing between the projections of the at least two consecutive cutting discs on the drum axis is 10 mm to 40 mm.

18. The hydromill wheel according to claim 1, wherein the spacing between the projections of the at least two consecutive cutting discs on the drum axis is constant.

19. The hydromill wheel according to claim 1, wherein the rotational axes of the at least two consecutive cutting discs are parallel to the rotational axis of the drum.

20. A method of excavating a trench in rock by use of a hydromill having at least one drum equipped with single disc cutters, the method comprising:

rotating the drum about an axis by an engine, the axis extending laterally below a body of the hydromill;

arranging a plurality of single disc cutters mounted on the periphery of the drum to come in contact with the rock, each said single disc cutter having a rotatable single cutting disc, each said rotatable single cutting disc having a single cutting edge arranged to come in contact with the rock; and lowering the drum into the rock such that a weight of the hydromill is supported by the single disc cutters on a bottom of the drum for creating fractures in the rock for excavating the rock, the spacing between at least two consecutive fractures being 10 mm to 70 mm.

* * * * *